United States Patent [19]

Machin et al.

[11] Patent Number: 4,911,857

[45] Date of Patent: Mar. 27, 1990

[54] AQUEOUS LIQUID ABRASIVE CLEANING COMPOSITION: PARTICULATE ABRASIVE SUSPENDED IN AQUEOUS MEDIUM

[75] Inventors: David Machin, Birkenhead, England; Cornelis B. Donker, Dordrecht; Johannes C. Van de Pas, Vlaardingen, both of Netherlands

[73] Assignee: Lever Brothers Company, New York, N.Y.

[21] Appl. No.: 224,516

[22] Filed: Jul. 26, 1988

[30] Foreign Application Priority Data

Jul. 31, 1987 [GB] United Kingdom ..... 8718219

[51] Int. Cl.[4] ..... C11D 3/14; C11D 10/04; C11D 9/10; C11D 17/00

[52] U.S. Cl. ..... 252/98; 252/108; 252/117; 252/120; 252/121; 252/132; 252/173; 252/174.19; 252/174.24; 252/174.25; 252/DIG. 14

[58] Field of Search ..... 252/108, 98, 120

[56] References Cited

U.S. PATENT DOCUMENTS

| | | | |
|---|---|---|---|
| 4,181,633 | 1/1980 | Colodney et al. | 252/525 |
| 4,534,892 | 8/1985 | Suzuki et al. | 252/545 |
| 4,657,692 | 4/1987 | Choy et al. | 252/99 |
| 4,695,394 | 9/1987 | Choy et al. | 252/97 |
| 4,767,653 | 8/1988 | de Buzzaccarini | 252/174.25 |

FOREIGN PATENT DOCUMENTS

| | | |
|---|---|---|
| 101920 | 3/1984 | European Pat. Off. . |
| 126545 | 11/1984 | European Pat. Off. . |
| 206534 | 12/1986 | European Pat. Off. . |
| 214540 | 3/1987 | European Pat. Off. . |

*Primary Examiner*—A. Lionel Clingman
*Attorney, Agent, or Firm*—Matthew J. McDonald

[57] ABSTRACT

In an aqueous liquid cleaning composition containing anionic synthetic detergent, soap, electrolyte, and particulate abrasive, with the electrolyte being other than tripolyphosphate, the ability to wet a stainless steel surface is enhanced by including 0.01 to 0.5% of polyacrylate or methacrylate having molecular weight of 500 to 3000.

10 Claims, No Drawings

AQUEOUS LIQUID ABRASIVE CLEANING COMPOSITION: PARTICULATE ABRASIVE SUSPENDED IN AQUEOUS MEDIUM

The present invention relates to a liquid aqueous abrasive cleaning composition with improved wetting properties.

Liquid aqueous abrasive cleaning compositions have been known in the art for many years. They are mainly used for cleaning of hard surfaces to facilitate the removal of stubborn soils, greases, burnt-in materials which are far less easily removed with abrasive-free cleaning compositions. Usually, such liquid aqueous abrasive cleaning compositions consist of an aqueous suspending medium in which particulate abrasive material is stably suspended. The aqueous suspending medium usually consists of an aqueous solution of an anionic detergent or a mixture thereof with a nonionic detergent, and a water-soluble organic and/or inorganic salt in amounts such that the aqueous solution obtains suspending properties. Commonly, the water-soluble salt is a phosphate such as pentasodium triphosphate, but in view of the overall trend in the detergent industry to reduce the phosphorus level in detergent compositions in view of the eutrophication problem, recently there have been proposals to reduce the phosphorus level in liquid aqueous abrasive cleaning compositions as well, or even to suppress the use of pentasodium triphosphate in such compositions altogether.

Thus, we have proposed in our published European patent application 0 214 540 an aqueous liquid abrasive cleaning composition which is free from phosphates, and instead contains an electrolyte selected from the group consisting of alkali metal and ammonium salts of citric, carbonic, hydrochloric, succinic, adipic and glutaric acid.

In many liquid aqueous abrasive cleaning compositions the anionic detergent usually comprises a mixture of a synthetic anionic detergent such as the alkali metal, ammonium and alkanolamine salts of $C_{12}$–$C_{18}$ branched or straight chain alkylbenzenesulphonic acids, of $C_{12}$–$C_{18}$ branched or straight chain alkanesulphonic acids, of $C_{12}$–$C_{18}$ alkylmonosulphuric acid esters, of $C_6$–$C_{18}$ dialkylmono- and disulphosuccinic acid esters, of $C_{10}$–$C_{18}$ alkyl $(EO)_{1-10}$ monosulphuric acid esters, together with an alkali metal, ammonium or alkanolamine salt of a $C_{10}$–$C_{24}$ fatty acid (hereinafter referred to as "soap").

However, we have found that, if the pentasodium triphosphate in an aqueous liquid abrasive cleaning composition consisting a mixture of a synthetic anionic detergent and a soap is replaced by another water-soluble inorganic and/or organic salt which is not a phosphate, the wetting properties of the resulting product are significantly impaired.

By wetting is meant that if an object which has been cleaned with the liquid aqueous abrasive cleaner is subsequently rinsed with water, the water should spread out over the surface of the object as a film instead of droplets. On drying the object, the latter may cause an unsightly spotty appearance of the surface of the object.

We have now found that we can significantly improve the wetting properties of the above-discussed liquid abrasive cleaning compositions which contain a mixture of an anionic synthetic detergent and a soap and which are free from phosphates, by including therein from 0.01–0.5% by weight of a polymer which is polyacrylate or poly(meth)acrylate having a molecular weight of between 500 and 3,000.

The choice of the type of polymer, the molecular weight of the polymer and the relative amount of the polymer to be used was found to be critical. Thus, the type of polymer to be used is a polyacrylate or poly(meth)acrylate. Other acrylic acid-containing (co)polymers or cross-linked polyacrylates are not suitable as they give unsatisfactory products. Equally, polymers having a molecular weight outside the above-identified range are not suitable. Furthermore, if the polymer is used in an amount outside the above-identified level, unsatisfactory products are obtained.

The molecular weight preferably ranges from 1,000 to 2,000, and the level at which it is used preferably ranges from 0.05–0.23% by weight of the final composition.

The liquid aqueous abrasive cleaning composition of the invention contains in general from 0.5–15% by weight, and preferably from 1–5% by weight of the anionic synthetic detergent. The soap is present in an amount of from 0.25–5% by weight, preferably from 0.5–3% by weight.

It is often desirable to include also a nonionic or zwitterionic detergent material in the aqueous medium in an amount of from 0.3–7%, preferably from 0.5–5% by weight. Suitable examples of nonionic detergents are water-soluble condensation products of ethylene oxide and/or propylene oxide with linear primary or secondary $C_8$–$C_{18}$ alcohols, with $C_8$–$C_{18}$ fatty acid amides or fatty acid alkylolamides (both mono- and diamides), with $C_9$–$C_{18}$ alkyl phenols and so on. The alkoxylated $C_8$–$C_{18}$ fatty acid mono- and dialkylolamides should contain more than one alkylene oxide unit; for example, they should be condensed with e.g. 2–5 moles of alkylene oxide such as ethylene oxide. Fatty acid mono- or dialkylolamides in which the fatty acid radical contains 10–16 carbon atoms are also suitable nonionics, such as for instance coco fatty acid mono- or diethanolamide.

Suitable zwitterionic detergents are trialkyl amine oxides having one long alkyl chain ($C_8$–$C_{18}$) and two short ($C_1$–$C_4$) alkyl chains; betaines and sulphobetaines.

It is highly desirable that the liquid medium should exhibit Bingham plastic characteristics, thus forming a stable suspending medium for the mineral abrasive. Such media using the above-mentioned surfactants, possibly in combination with other surfactants, are described in British patent specifications 1 167 597, 1 181 607, 1 262 280, 1 303 810, 1 308 190 and 1 418 671.

As indicated above, as a further essential component of the suspending medium, one or more organic or inorganic salts (i.e. electrolytes) are included, which must not be of the phosphate type.

Suitable electrolytes are selected from the group consisting of alkali metal and ammonium salts of citric, carbonic, sulphuric, hydrochloric, succinic, adipic and glutaric acids.

Preferred electrolytes are the alkali metal salts of citric and carbonic acid, such as sodium citrate, sodium carbonate and sodium bicarbonate. The level of electrolyte depends on the particular surfactant system of choice and in general ranges from 0.5–25% by weight, preferably from 1–7% by weight.

The compositions of the present invention optionally include a bleaching agent of the chlorine-releasing type, such as sodium hypochlorite and isocyanurate.

Other adjuncts for liquid abrasive cleansers may be included, such as colouring agents, perfumes, fluorescers, hydrotropes, soil-suspending agents, enzymes, opacifiers, germicides, humectants, etc.

Suitable for use as the abrasive material in the compositions of the invention are both natural and synthetic mineral abrasives, for example dolomite, precipitated calcium carbonate (aragonite), feldspar, alumina, silica, abrasives such as quartz and quartzite; and preferably an abrasive material is used with a hardness on Moh's scale of from 1 to 4. Particularly suitable is calcite, for instance limestone, chalk or marble such as those forms of calcite referred to in the British Patent 1 345 119. In general, the average particle size of the abrasive materials ranges from 1–70, usually 1–60, preferably 1–50 micrometers.

The mineral abrasive is included in an amount of from 25–70% by weight of the composition, preferably of from 45–55% by weight.

The invention will further be described by the following Examples, in which quantities are expressed by percentages by weight of the total composition unless otherwise indicated.

The following Examples set out a number of formulations of liquid abrasive cleaners. Some exemplify the invention. Others are comparative. Where appropriate unsatisfactory properties are noted.

Each formulation was assessed for a "wetting score". This was on a scale ranging from 0=bad wetting to 5=good wetting. The score was assessed by a panel of 3 judges, who assessed the wet surface of a stainless steel sink which had been cleaned with the liquid abrasive cleaning composition and subsequently rinsed with water. Thereafter the steel surface was wetted with a sponge and the water-film was then assessed.

| | Examples A–G | | | | | | |
|---|---|---|---|---|---|---|---|
| | A | B | C | D | E | F | G |
| Sodium linear dodecylbenzenesulphonate | 3.00 | 3.00 | 3.0 | 3.00 | 3.00 | 3.00 | 3.00 |
| $C_{12}$–$C_{13}$ linear primary alcohol, condensed with 6.5 moles of ethylene oxide | 1.25 | 1.25 | 1.25 | 1.25 | 1.25 | 1.25 | 1.25 |
| Sodium soap of coconut fatty acids | 0.75 | 0.75 | 0.75 | 0.25 | 0.25 | 0.25 | 0.50 |
| Sodium carbonate | 2.50 | 3.30 | 2.50 | 3.50 | 3.50 | 3.50 | 3.50 |
| Sodium bicarbonate | 0.50 | 0.70 | 0.50 | 0.50 | 0.50 | 0.50 | 0.50 |
| Pentasodium triphosphate | 1.00 | — | — | — | — | — | — |
| Sodium citrate 2 aq. | — | — | 1.00 | — | — | — | — |
| Calcite (average particle size 15 micrometers) | 50.00 | 50.00 | 50.00 | 50.00 | 50.00 | 50.00 | 50.00 |
| Perfume | 0.30 | 0.30 | 0.30 | 0.30 | 0.30 | 0.30 | 0.30 |
| Water-soluble polymer of acrylic acid, cross-linked with about 1% of a polyalkylether of sucrose, having an average of about 5.8 alkyl groups per sucrose molecule, molecular weight above $10^6$ (Carbopol 941 ® ex B. F. Goodrich Co. Ltd.) | — | — | — | 0.50* | — | — | 0.10* |
| Sodium polyacrylate, molecular weight 2,000 | — | — | — | — | 0.30 | — | — |
| Copolymer of maleic anhydride with acrylic acid, sodium salt, molecular weight 70,000 (Sokalan CP5 ® ex BASF) | — | — | — | — | — | 0.50** | — |
| Sodium polyacrylate, molecular weight 1,200 | — | — | — | — | — | — | — |
| Wetting Score (0–5) | 4–5 | 0 | 0 | 4–5 | 4–5 | 4–5 | 3–5 |

| | Examples H–N | | | | | |
|---|---|---|---|---|---|---|
| | H | J | K | L | M | N |
| Sodium linear dodecylbenzenesulphonate | 3.00 | 3.00 | 3.0 | 3.00 | 3.00 | 3.00 |
| $C_{12}$–$C_{13}$ linear primary alcohol, condensed with 6.5 moles of ethylene oxide | 1.25 | 1.25 | 1.25 | 1.25 | 1.25 | 1.25 |
| Sodium soap of coconut fatty acids | 0.50 | 0.50 | 0.50 | 0.50 | 0.75 | 0.75 |
| Sodium carbonate | 3.50 | 3.50 | 3.50 | 3.50 | 3.30 | 2.50 |
| Sodium bicarbonate | 0.50 | 0.50 | 0.50 | 0.50 | 0.70 | 0.50 |
| Pentasodium triphosphate | — | — | — | — | — | — |
| Sodium citrate 2 aq. | — | — | — | — | — | 1.00 |
| Calcite (average particle size 15 micrometers) | 50.00 | 50.00 | 50.00 | 50.00 | 50.00 | 50.00 |
| Perfume | 0.30 | 0.30 | 0.30 | 0.30 | 0.30 | 0.30 |
| Water-soluble polymer of acrylic acid, cross-linked with about 1% of a polyalkylether of sucrose, having an average of about 5.8 alkyl groups per sucrose molecule, molecular weight above $10^6$ (Carbopol 941 ® ex B. F. Goodrich Co. Ltd.) | 0.05* | — | — | — | — | — |
| Sodium polyacrylate, molecular weight 2,000 | — | — | — | — | — | — |
| Copolymer of maleic anhydride with acrylic acid, sodium salt, molecular weight 70,000 (Sokalan CP5 ® ex BASF) | — | — | — | — | — | — |
| Sodium polyacrylate, molecular weight 1,200 | — | 0.225 | 0.09 | 0.045 | 0.09 | 0.09 |
| Wetting Score (0–5) | 4–5 | 4–5 | 4–5 | 3–5 | 4–5 | 4–5 |

*Product was severely thickened and could only be rinsed with great difficulty.
**Product was not stable; separated immediately into different phases.

EXAMPLES O AND P

The following formulations were also tested as regards their wetting characteristics:

| | O | P |
|---|---|---|
| Laurydimethylamine oxide | 1.75 | 1.75 |
| Sodium $C_{14}$–$C_{17}$ alkanesulphonate | 1.75 | 1.75 |
| Potassium soap of coconut fatty acids | 0.43 | 0.43 |
| Sodium carbonate | 4.00 | 4.00 |
| Calcite (average particle size 15 micrometers) | 50.00 | 50.00 |
| Sodium hypochlorite | 1.50 | 1.50 |

-continued

| | O | P |
|---|---|---|
| Perfume | 0.30 | 0.30 |
| Sodium polyacrylate, molecular weight 1,200 | — | 0.09 |
| Wetting score | 0 | 5 |

Wetting score

In the various Examples, a good wetting score was obtained with formulation A which contained tripolyphosphate, formulations D, F, G and H which gave products with unsatisfactory properties, and formulations E, J to N and P which embody this invention.

We claim:

1. In an aqueous liquid cleaning composition of the type containing an aqueous suspending medium and a particulate abrasive material stably suspended therein, the suspending medium including an aqueous solution of a mixture of synthetic anionic detergent, soap and water-soluble organic and/or inorganic salt which is other than phospate, the improvement comprising the presence of from 0.01 to 0.5% by weight of a polyacrylate or polymethacrylate having a molecular weight of between 500 and 3000.

2. A composition as claimed in claim 1 wherein the molecular weight of the polyacrylate or polymethacrylate is in the range from 1000 to 2000.

3. A composition as claimed in claim 1 wherein the amount of the polyacrylate or polymethacrylate is from 0.05 to 0.23% by weight of the composition.

4. A composition as claimed in claim 1 which contains 0.05 to 15% by weight of the said synthetic anionic detergent;

0.25 to 5% by weight of the said soap, which soap is an alkali metal, ammonium or alkanolamine salt of a $C_{10}$ to $C_{24}$ fatty acid;

0.5 to 25% by weight of the said salt; and 25 to 70% of said particulate abrasive.

5. A composition as claimed in claim 1 wherein the said synthetic anionic detergent is selected from alkali metal, ammonium and alkanolamine salts of $C_{12}$–$C_{18}$ branched or straight chain alkylbenzenesulphonic acids, $C_{12}$–$C_{18}$ branched or straight chain alkanesulphonic acids, $C_{12}$–$C_{18}$ alkylmonosulphuric acid esters, $C_6$–$C_{18}$ dialkylmono- and disulphosuccinic acid esters and $C_{10}$–$C_{18}$ alkyl $(EO)_{1\text{-}10}$ monosulphuric acid esters.

6. A composition as claimed in claim 1 wherein the said organic or inorganic salt is selected from alkali metal and ammonium salts of citric, carbonic, sulphuric, hydrochloric, succinic, adipic and glutaric acids.

7. A composition as claimed in claim 1 wherein the said organic or inorganic salt is selected from alkali metal salts of citric and carbonic acids.

8. A composition as claimed in claim 1 additionally containing from 0.3 to 7% by weight of zwitterionic or nonionic detergent selected from condensation products of ethylene oxide and/or propylene oxide, fatty acid mono- or dialkylolamides, trialkyl amine oxides having one $C_8$–$C_{18}$ alkyl chain and two $C_1$–$C_4$ alkyl chains, betaines and sulphobetaines.

9. A composition as claimed in claim 1 additionally containing a chlorine-releasing bleaching agent.

10. A composition as claimed in claim 1 wherein the abrasive material is a mineral abrasive having a hardness on Moh's scale of 1 to 4 and a particle size from 1 to 70 micrometers.

* * * * *